US011236736B2

(12) United States Patent
Parsons et al.

(10) Patent No.: US 11,236,736 B2
(45) Date of Patent: Feb. 1, 2022

(54) AXIAL PISTON PUMP WITH PORT PLATE HAVING BALANCE FEED APERTURE RELIEF FEATURE

(71) Applicant: HONEYWELL INTERNATIONAL INC., Morris Plains, NJ (US)

(72) Inventors: Abigail Parsons, South Bend, IN (US); William Scott Rowan, South Bend, IN (US); Larry Portolese, Granger, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 202 days.

(21) Appl. No.: 16/586,672

(22) Filed: Sep. 27, 2019

(65) Prior Publication Data

US 2021/0095647 A1 Apr. 1, 2021

(51) Int. Cl.
*F04B 11/00* (2006.01)
*F04B 53/16* (2006.01)
(Continued)

(52) U.S. Cl.
CPC ..... *F04B 11/0091* (2013.01); *F04B 1/20* (2013.01); *F04B 1/2007* (2013.01); *F04B 1/2021* (2013.01); *F04B 53/162* (2013.01)

(58) Field of Classification Search
CPC ..... F04B 1/20; F04B 1/2007; F04B 1/2021; F04B 1/324; F04B 27/0839;
(Continued)

(56) References Cited

U.S. PATENT DOCUMENTS 2,284,109 A * 5/1942 Vickers ..... F01B 3/0064 91/485
2,642,809 A * 6/1953 Born ..... F01B 3/0047 91/6.5
(Continued)

FOREIGN PATENT DOCUMENTS

CN 103486016 A 1/2014
CN 204212967 U 3/2015
(Continued)

OTHER PUBLICATIONS

Xu et al., A new design method for the transition region of the valve plate for an axial piston pump, Journal of Zhejiang University—SCIENCE A (Applied Physics & Engineering), 2015, 16(3)1229-240, Hangzhou, China.

*Primary Examiner* — Alexander B Comley
(74) *Attorney, Agent, or Firm* — Lorenz & Kopf, LLP

(57) ABSTRACT

A piston pump includes a ported member that is moveably disposed within an internal space of a housing between a rotating group and the housing. The ported member includes a first face facing the rotating group and a second face facing a fluid inlet and outlet. The ported member includes an intake port and a discharge port. Moreover, the ported member includes a balance aperture configured to pass fluid between the biasing member and a pump chamber as the rotating group rotates within the internal space such that the biasing member biases the ported member toward a balanced position within the internal space. The balance aperture has a rim at the first face. The rim is clefted at a relief feature of the first face. The relief feature is recessed into the first face.

20 Claims, 9 Drawing Sheets

(51) Int. Cl.
*F04B 1/2021* (2020.01)
*F04B 1/20* (2020.01)
*F04B 1/2007* (2020.01)

(58) Field of Classification Search
CPC ..... F04B 39/1066; F04B 11/0091; F04B 53/162; F01B 3/0041; F01B 3/0047
USPC ..... 417/222.1, 222.2, 269–272; 92/12.1–13, 92/57; 91/499, 504–505
See application file for complete search history.

(56) References Cited

U.S. PATENT DOCUMENTS 2,975,720 A * 3/1961 Schoellhammer .... F01B 3/0055 384/368
3,059,432 A * 10/1962 Thoma ..... F01B 3/0073 60/437
3,110,267 A * 11/1963 Vetter ..... F04B 1/2007 91/485
3,255,673 A * 6/1966 Thoma ..... F01B 3/0055 91/485
3,267,871 A * 8/1966 Lee ..... F01B 3/0041 137/625.21
3,585,901 A * 6/1971 Moon, Jr. ..... F04B 1/2021 91/6.5
3,625,253 A * 12/1971 Christiansen ..... F01B 3/0055 137/625.21
3,800,672 A * 4/1974 Kobald ..... F04B 1/2035 91/487
3,802,321 A * 4/1974 Bosch ..... F01B 3/0064 91/485
3,904,318 A * 9/1975 Born ..... F04B 1/2007 417/199.1
3,910,587 A * 10/1975 Loeffler ..... F16J 15/02 277/401
4,142,450 A * 3/1979 Thoma ..... F04B 1/20 91/485
4,475,443 A * 10/1984 Forster ..... F01B 3/0047 210/416.1
4,771,676 A * 9/1988 Matsumoto ..... F04B 1/2007 417/269
4,801,247 A * 1/1989 Hashimoto ..... F04B 1/324 417/213
4,934,253 A * 6/1990 Berthold ..... F04B 1/2042 91/506
5,230,274 A * 7/1993 Yu ..... F04B 1/2042 91/485
5,253,983 A * 10/1993 Suzuki ..... F04B 1/2021 417/485
5,572,919 A * 11/1996 Ishizaki ..... F04B 1/2021 417/270
5,634,776 A * 6/1997 Leemhuis ..... F04B 1/2042 417/270
5,807,080 A * 9/1998 Ochiai ..... F04B 1/2021 417/269
6,186,748 B1 * 2/2001 Umeda ..... F04B 1/2042 417/269
6,361,285 B1 * 3/2002 Lehner ..... F04B 1/2042 417/269
6,510,779 B2 * 1/2003 Greene ..... F04B 1/2021 417/270
7,500,424 B2 * 3/2009 Gray, Jr. ..... F04B 1/2021 417/269
7,661,937 B2 * 2/2010 Beck ..... F04B 1/2021 417/560
7,988,433 B2 * 8/2011 Akei ..... F01C 1/0215 418/55.5
8,025,492 B2 * 9/2011 Seibel ..... F04C 18/0215 418/55.4
9,115,748 B2 * 8/2015 Ivantysynova ..... F04B 1/2028
9,657,726 B1 * 5/2017 Bonny ..... F04B 27/0804
9,803,634 B2 10/2017 May
9,915,249 B2 * 3/2018 Suzuki ..... F04B 1/2035
10,294,789 B2 * 5/2019 Krittian ..... F04B 1/20
10,690,124 B2 * 6/2020 Porel ..... F04B 1/328

FOREIGN PATENT DOCUMENTS

CN 103939330 B 4/2016
CN 205638890 U 10/2016
CN 107762757 A 3/2018
DE 10200545 A1 * 6/2003 ..... F03C 1/0655
WO 2018215514 A1 11/2018

* cited by examiner

AXIAL PISTON PUMP WITH PORT PLATE HAVING BALANCE FEED APERTURE RELIEF FEATURE

TECHNICAL FIELD

The present disclosure generally relates to an axial piston pump and, more particularly, to an axial piston pump with a port plate having a balance feed aperture relief feature.

BACKGROUND

There are various types of pumps configured for pumping fluids. For example, there are various types of positive displacement, continuous travel piston pumps that have been developed for various uses.

Characteristics of the fluid flow through the pump may correlate to the wear rate and durability of pump. For example, flow of the pumped fluid that produces cavitation may cause premature wear and/or malfunction of the pump. The collapsing vapor bubbles associated with cavitation can cause excessive vibration and loss of fluid film, which can cause rotating parts to contact non-rotating parts, causing damage.

Accordingly, it is desirable to provide a piston pump with improved flow characteristics and that reduces wear due to cavitation. It is also desirable to provide a piston pump that has increased durability. Other desirable features and characteristics of the present disclosure will become apparent from the subsequent detailed description and the appended claims, taken in conjunction with the accompanying drawings and this background discussion.

BRIEF SUMMARY

In one embodiment, a piston pump is disclosed that is configured to displace a fluid. The piston pump includes a housing that defines an internal space. The housing has a fluid inlet into the internal space, and the housing has a fluid outlet out of the internal space. The pump further includes a rotating group that is supported for rotation within the internal space of the housing. The rotating group includes a rotor member with a bore therein and a piston supported for movement within the bore as the rotating group rotates to change a volume of a pump chamber that is cooperatively defined by the piston and the rotor member. The piston pump further includes a biasing member and a ported member that is moveably disposed within the internal space of the housing between the rotating group and the housing. The ported member includes a first face facing the rotating group and a second face facing the fluid inlet and the fluid outlet. The ported member includes an intake port that fluidly connects the fluid inlet and the pump chamber as the rotating group rotates within the internal space. The ported member also includes a discharge port that fluidly connects the pump chamber and the fluid outlet as the rotating group rotates within the internal space. Moreover, the ported member includes a balance aperture configured to pass fluid between the biasing member and the pump chamber as the rotating group rotates within the internal space such that the biasing member biases the ported member toward a balanced position within the internal space. The balance aperture has a rim at the first face. The rim is clefted at a relief feature of the first face. The relief feature is recessed into the first face.

In another embodiment, a method of operating an axial piston pump is disclosed. The method includes rotating a rotating group of the axial piston pump within an internal space of a housing of the axial piston pump. The housing has a fluid inlet into the internal space and a fluid outlet out of the internal space. The method further includes moving a piston of the rotating group reciprocally in an axial direction within a bore of the rotating group to move a fluid through a pump chamber that is cooperatively defined by the piston and the rotor member. Furthermore, the method includes moving the fluid through a ported member that is moveably disposed within the internal space of the housing between the rotating group and the housing. The ported member includes a first face facing the rotating group and a second face facing the fluid inlet and the fluid outlet. Moving the fluid through the ported member includes: moving the fluid from the fluid inlet to the pump chamber via an intake port of the ported member as the rotating group rotates within the internal space; moving the fluid from the pump chamber to the fluid outlet via a discharge port of the ported member as the rotating group rotates within the internal space; and passing the fluid between the pump chamber and a biasing member via a balance aperture of the ported member as the rotating group rotates within the internal space such that the biasing member biases the ported member toward a balanced position within the internal space. Passing the fluid between the pump chamber and the biasing member includes passing the fluid through a clefted rim of the balance aperture defined at the first face. The rim is clefted at a relief feature of the first face, and the relief feature is recessed into the first face.

In a further embodiment, an axial piston pump is configured to displace a fluid. The axial piston pump includes a housing with an end that partly defines an internal space within the housing. The end has a fluid inlet into the internal space, and the end has a fluid outlet out of the internal space. The axial piston pump also includes a rotating group that is supported for rotation within the internal space of the housing. The rotating group includes a rotor member with a bore therein and a piston supported for reciprocating movement in an axial direction within the bore as the rotating group rotates to change a volume of a pump chamber that is cooperatively defined by the piston and the rotor member. Moreover, the axial piston pump includes a first biasing member and a second biasing member. Also, the axial piston pump includes a ported member that is moveably disposed within the internal space of the housing between the rotating group and the end. The ported member includes a first face facing the rotating group and a second face facing the end. The ported member includes an intake port that fluidly connects the fluid inlet and the pump chamber as the rotating group rotates within the internal space. The ported member includes a discharge port that fluidly connects the pump chamber and the fluid outlet as the rotating group rotates within the internal space. Also, the ported member includes a first balance aperture configured to pass fluid between the pump chamber and a first pocket that receives the first biasing member as the rotating group rotates within the internal space such that the first biasing member biases the ported member toward a balanced position within the internal space. Furthermore, the ported member includes a second balance aperture configured to pass fluid between the pump chamber and a second pocket that receives the second biasing member as the rotating group rotates within the internal space such that the second biasing member biases the ported member toward the balanced position within the internal space. The first balance aperture has a first rim at the first face, and the first rim is clefted on a trailing side of the first balance aperture at a first relief feature of the first face. The first relief feature is recessed into the first face. Moreover, the second balance aperture has a second rim at the first face. The second rim is clefted on a trailing side of the second balance aperture at a second relief feature of the first face. The second relief feature is recessed into the first face.

BRIEF DESCRIPTION OF THE DRAWINGS

The present disclosure will hereinafter be described in conjunction with the following drawing figures, wherein like numerals denote like elements, and wherein.

Figure 1:
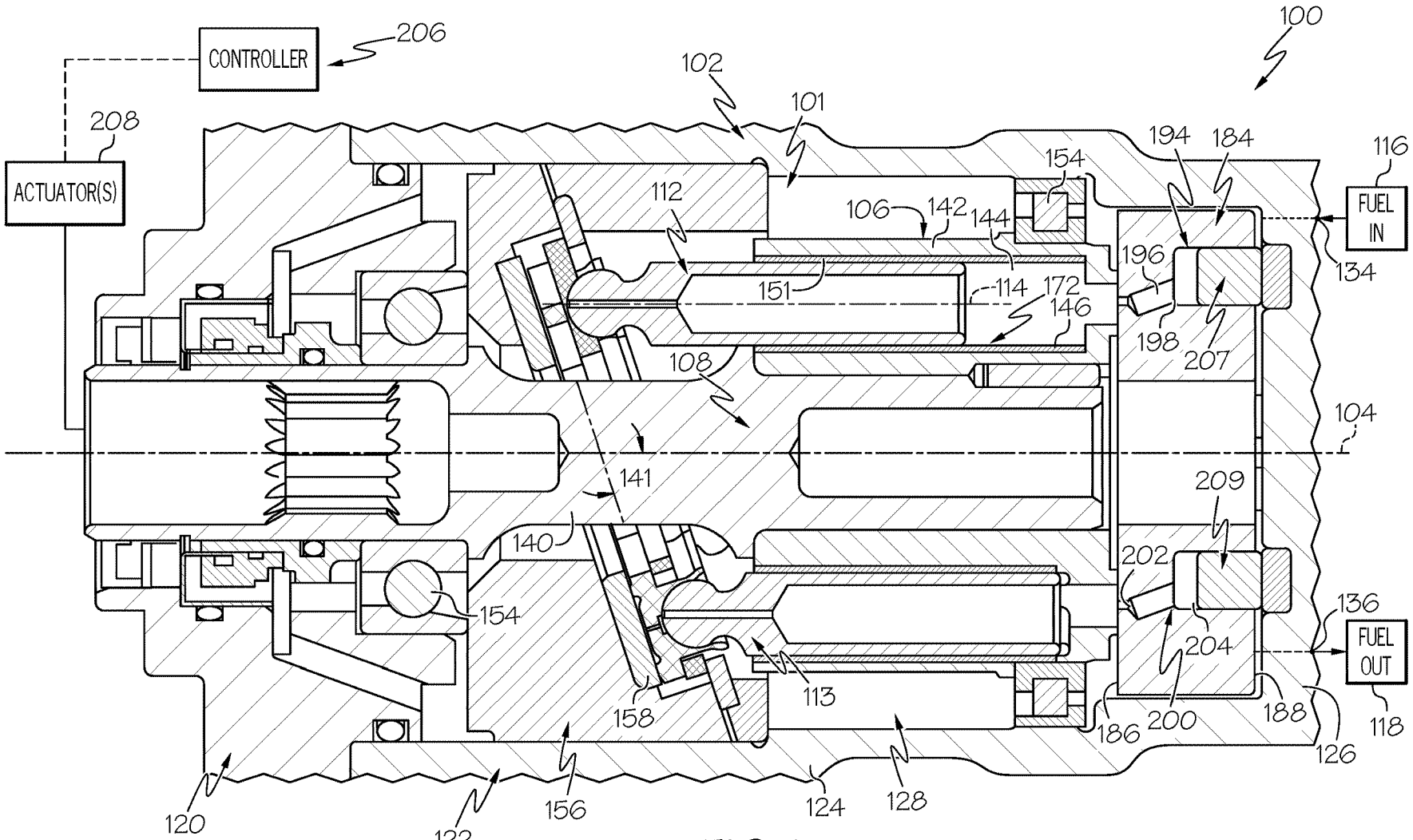
FIG. 1 is a longitudinal cross-section view of an axial piston pump of a pump system according to example embodiments of the present disclosure.

The drawings are not necessarily drawn to scale unless otherwise noted.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

Broadly, example embodiments disclosed herein include pump systems with a piston pump, such as an axial piston pump, having one or more features that improve the flow of fluid therethrough. The pump reduces damage due to cavitation during operation of the pump. This results in a pump having increased durability and robustness. These features may also increase reliability and usefulness across a wide range of operating conditions. Furthermore, the pump system may be used to pump a wide variety of fluids, including low-lubricity fluids (e.g., fuel).

In some embodiments, the pump may be an axial piston pump with a ported member that directs fluid flow into and out of the pistons as the rotating group rotates within the housing. The ported member may be referred to as a "port plate." The port plate may be moveably supported within the pump proximate the inlet and outlet of the housing. The port plate may "float" such that a thin film of the pumped fluid is maintained between the port plate and the rotating group and between the port plate and the housing. The port plate may also be supported by one or more biasing members (e.g., piston-like springs) that bias and counter-balance forces on the plate during pump operation. These biasing members may alternate from high to low pressure, depending on the pressure within the piston passing over the biasing member.

The port plate may include one or more balance apertures that provide fluid flow between the rotating group and the biasing member(s). The aperture may be a feed hole that fluidly connects the biasing member to the pressure field acting in the rotor/port plate interface. This fluid flow allows the biasing member to counter-balance forces on the port plate and resist tilting or shifting movement of the plate. At least one balance aperture may be formed through a surface of the port plate that faces the rotating group, and the aperture may extend through the port plate to a chamber that receives the biasing member.

The balance aperture may include one or more features that improve fluid flow therethrough and that reduces damage due to cavitation. For example, in some embodiments, the aperture may include a relief feature. The relief feature may be a tapered recess in the surface that faces the rotating group. The relief feature may be lobe-shaped and may be disposed at a rim of the balance aperture. In some embodiments, the relief feature may cleave or interrupt the rim. In other words, the rim of the balance aperture may be a cleft rim. The relief feature may be disposed on a trailing side of the aperture. Also, the transition portion may taper in depth gradually from adjacent areas of the face of the port plate to provide a smooth flow surface into and/or out of the balance aperture. The relief feature may control the rate of depressurization and fundamentally alter the flow field. For example, the port plate may drive collapsing cavitation bubbles away therefrom, minimizing damage to the port. Accordingly, these improvements increase durability of the pump. Also, these improvements allow the pump to be used with a wide variety of fluids, including fuel.

Referring now to FIG. 1, example embodiments of a pump system 100 will be discussed. The pump system 100 may include or comprise a pump 101 for selectively pumping a fluid therethrough. The pump 101 may be a positive displacement, continuous travel, piston pump. Specifically, the pump 101 may comprise an axial piston pump. However, it will be appreciated that one or more features of the present disclosure may apply to other piston pumps, such as a bent axis piston pump or a radial piston pump.

In some embodiments, the pump 101 may be used for pumping fuel. For example, the pump 101 may be included on a vehicle, such as an aircraft, and the pump 101 may pump fuel to an engine thereof. In some embodiments, the pump 101 may be configured as a main engine fuel pump. In additional embodiments, the pump 101 may be configured for pumping fluid for a hydraulic actuator.

Generally, the pump 101 may include a housing 102 that defines a longitudinal axis 104. The pump 101 also generally includes a rotating group 106 supported for rotation about the axis 104 within the housing 102. The rotating group 106 generally includes a rotor member 108 supported for rotation about the axis 104 and a plurality of pistons (e.g., a first piston 112 and a second piston 113) that are moveably supported by the rotor member 108. The first piston 112 and the second piston 113 are shown in FIG. 1, but it will be appreciated that the rotating group 106 may include any suitable number of pistons spaced apart circumferentially about the axis 114. The pistons 112, 113 may be received in respective bores 144 of the rotor member 108 and may slide axially along a respective bore axis 114. The pistons 112, 113 may be coupled to a cam retainer 156 (or a hanger in the case of a variable displacement pump) and a cam plate 158 of the rotor member 108, which are disposed at a non-orthogonal angle 141 (i.e., a cam angle) relative to the axis 104.

As will be described in detail below, the pistons 112, 113 may reciprocate axially along the respective bore axis 114 as the rotor member 108 rotates about the axis 104. It is noted that the bore axes 114 may be arranged parallel to the axis 104 (the centerline axis) of the shaft 140. This motion may cause the pistons 112, 113 to draw fluid into the respective bore 144 from a fluid intake system 116 and subsequently expel the fluid to a discharge system 118. The fluid intake system 116 may provide fuel to the pump 101 (e.g., from a fuel tank). The pump 101 may provide pressurized fluid to an engine, an actuator, or other device via the discharge system 118. Thus, the pump 101 may drive flow of the fluid through the system 100.

The housing 102 will now be discussed according to example embodiments. The housing 102 may include one or more rigid and strong components that support movement of the rotating group 106. The housing 102 may also house, contain, enclose, and/or encapsulate the rotating group 106 therein. The housing 102 may include a head 120 and a housing body 122. The housing body 122 may be a hollow, rigid member that includes a radial feature 124 and a longitudinal end 126. The head 120 may cover over and fixedly attach to the housing body 122 in a position that is longitudinally opposite the end 126. Accordingly, the head 120, the radial feature 124, and the end 126 may collectively define an internal space 128. The internal space 128 may be substantially cylindrical. The internal space 128 may be sealed off via one or more seals (e.g., between the head 120 and the housing body 122). The internal space may also include a fluid inlet 134 and a fluid outlet 136. In some embodiments, the end 126 may include one or more apertures that define the fluid inlet 134 and one or more apertures that define the fluid outlet 136. The fluid inlet 134 may be in fluid communication with the intake system 116, and the fluid outlet 136 may be in fluid communication with the discharge system 118.

Figure 2:
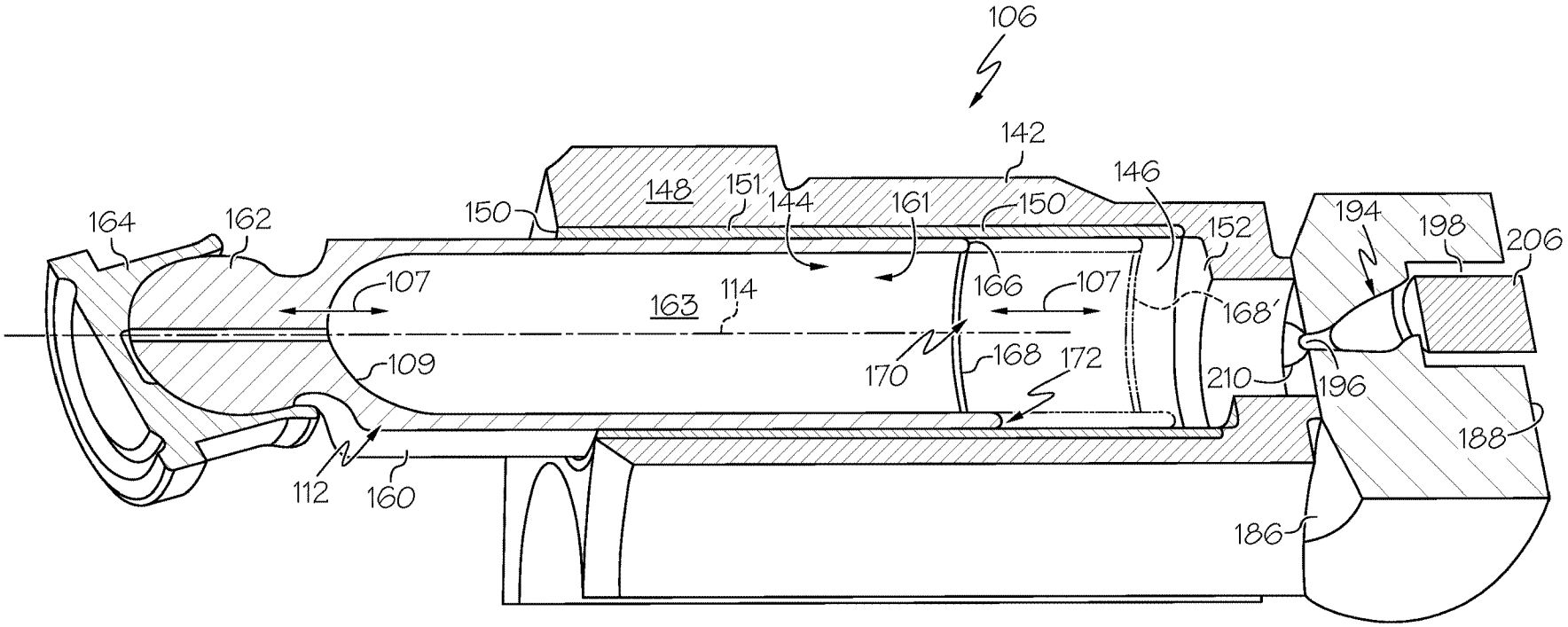
FIG. 2 is an isometric longitudinal cross-section view of a piston and a rotor member of the axial piston pump of FIG. 1.

Referring now to FIGS. 1 and 2, the rotating group 106 will be discussed in greater detail. The rotor member 108 of the rotating group 106 may include a shaft 140 that is centered on the axis 104. The rotor member 108 may also include a disc- or puck-shaped rotor body 142, which is fixed to one end of the shaft 140. The rotor member 108 may include a plurality of insert sleeves 151 that are removably and fixedly attached to the rotor body 142. The insert sleeves 151 may be hollow, cylindrical tubes. An inner surface 146 (inner diameter surface) of the sleeve 151 may define the respective bore 144 of the rotor member 108. As shown in FIG. 2, the plurality of bores 144 extend along the respective bore axis 114 and include a proximal end 150 and a distal end 152.

As shown in FIG. 1, the rotating group 106 may be supported for rotation within the housing 102 by one or more bearings 154. At least one bearing 154 may support the shaft 140 on the head 120 and at least one other bearing 154 may support the rotor body 142 on the housing body 122. Accordingly, the rotating group 106 may be supported for rotation within the internal space 128 of the housing 102. The bores 144 may be oriented with the respective distal ends 152 oriented toward the longitudinal end 126 of the housing 102. As will be discussed, the distal ends 152 may rotate about the axis 104 with rotation of the rotating group 106. Also, the distal ends 152 may be open and may intermittently connect to the fluid inlet 134 and, alternatively, to the fluid outlet 136 as the rotating group 106 rotates within the housing 102.

The pump 101 may also include the cam retainer 156, which is fixed to the housing 102, and which encircles the shaft 140. The pump 101 may also include the cam plate 158, which is supported by the cam retainer 156. The cam plate 158 may be disposed at the non-orthogonal cam angle 141 relative to the axis 104.

The first piston 112 is shown in detail in FIG. 2 as an example and may be representative of the second piston 113 as well as any additional pistons of the rotating group 106. As shown in FIG. 2, the piston 112 may be elongate and may extend longitudinally along the respective bore axis 114 between a first end 162 and a second end 166. The first end 162 may be rounded. The piston 112 may also include a hollow, cylindrical wall 115 that extends longitudinally from the first end 162 to define the second end 166. The wall 115 may terminate at an open, annular terminal end 168 (a second terminal end of the piston 112). The wall 115 defines a cylindrical outer surface 160 (e.g., an outer diameter surface). The wall 115 of the piston 112 may also include an inner cavity 161 defined by inner surface 163 (e.g., an inner diameter surface). The inner cavity 161 may be defined at one end by an inner longitudinal end 109 and may be open at the opposite longitudinal end.

The piston 112 may be disposed in the respective bore 144 with the first end 162 of the piston 112 disposed proximate the proximal end 150. The first end 162 may be received in a shoe 164, which is loaded against the cam plate 158. Also, the second end 166 of the piston 112 may be disposed proximate the distal end 152 of the bore 144.

The piston 112 and the rotor member 108 cooperatively define a pump chamber 170. Specifically, the pump chamber 170 may be defined by the inner surface 163 and the terminal end 168 of the piston 112 in cooperation with the inner surface 146 of the bore 144 at the distal end 152. The pump chamber 170 may be fluidly connected to the internal space 128 of the housing 102. Stated differently, the pump chamber 170 may be open at the distal end 152 of the bore 144. As such, the pump chamber 170 may intermittently connect to the fluid inlet 134 and, alternatively, to the fluid outlet 136 as the rotating group 106 rotates within the housing 102.

As mentioned, the piston 112 may be supported for reciprocating sliding movement in an axial direction within the bore 144. This changes a volume of the pump chamber 170. Specifically, as the rotating group 106 rotates about the axis 104, the shoe 164 pushes the first end 162 of the piston 112 circumferentially about the axis 104, and the cam plate 158 cams against the first end 162 to reciprocate the piston 112 axially along its respective bore axis 114, in and out of the proximal end 150 of the bore 144. Meanwhile the second end 166 of the piston moves toward and away from the distal end 152 of the bore 144 as the rotating group 106 rotates about the axis 104.

A stroke of the piston 112 is illustrated in FIG. 2. As shown, the second terminal end 168 is shown in solid lines to demonstrate a first axial position of the piston 112 within the bore 144 with respect to the axis 114. In some embodiments, this first axial position may be the bottom dead center position of the piston 112. The second terminal end 168 is shown in phantom lines to demonstrate a second axial position of the piston 112 within the bore 144. In some embodiments, this second axial position may be the top dead center position of the piston 112. The piston 112 may reciprocate between these two axial positions as indicated by arrow 107. The stroke (i.e., stroke length, stroke zone, etc.) of the piston 112 is the axial distance (measured along the axis 114) between the two positions. Thus, the stroke is the distance that the piston 112 travels as it moves between the two positions. The piston 112 may complete the stroke as the rotating group 106 completes a single rotation around the axis 104.

Figure 3:
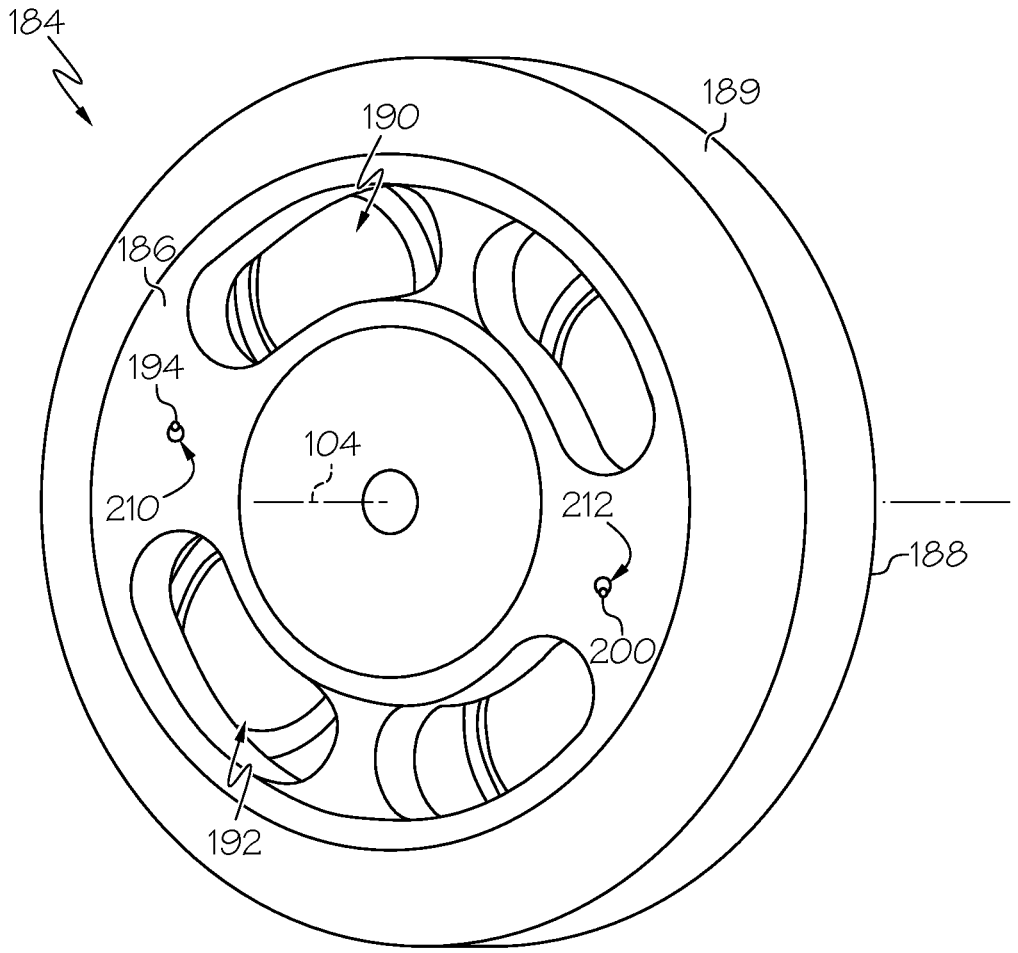
FIG. 3 is an isometric view of a ported member of the axial piston pump of FIG. 1 according to example embodiments.

The pump 101 may further include a ported member 184 (i.e., a port plate). As shown in FIG. 3, the ported member 184 may be a rounded plate with a disc-like shape. As shown in FIG. 1, the ported member 184 may be disposed between the rotating group 106 and the end 126 of the housing 102. The ported member 184 may include a first face 186 that faces the rotating group 106 and a second face 188 that faces the end 126 of the housing 102. As such, the first face 186 may face the pistons 112, 113 while the second face 188 may face the fluid inlet 134 and the fluid outlet 136 in the end 126 of the housing 102. The ported member 184 may further include an outer edge 189 that faces the radial feature 124 of the housing 102. The ported member 184 may be nested within the housing 102 proximate the fluid inlet 134 and the fluid outlet 136.

Furthermore, the ported member 184 may include at least one intake port 190. The intake port 190 may be arcuate (e.g., kidney-shaped) and may extend partially about the axis 104. The intake port 190 may define a passage through the ported member 184 between the first face 186 and the second face 188 of the ported member 184. In some embodiments, there may be plural, individual passages that extend from the first face 186 to the second face 188 with different surface features configured to direct flow of fluid (e.g., fuel) through the ported member 184 from the second face 188 to the first face 186. The ported member 184 may be disposed within the housing 102 with the intake port 190 aligned with and in fluid communication with the fluid inlet 134. Moreover, the intake port 190 may be disposed substantially at the same radius as the pistons 112, 113 relative to the axis 104. Thus, the pistons 112, 113 may draw flow through the intake port 190 when the pistons 112, 113 come into alignment with the intake port 190. In other words, the intake port 190 temporarily fluidly connects the fluid inlet 134 and the pump chamber 170 of the first piston 112 as the rotating group 106 rotates within the internal space 128. The intake port 190 likewise temporarily fluidly connects the fluid inlet 134 and the pump chamber 170 of the second piston 113 as well as the other pistons as they rotate about the axis 104 with rotation of the rotating group 106.

Additionally, the ported member 184 may include at least one discharge port 192. The discharge port 192 may be arcuate (e.g., kidney-shaped) and may extend partially about the axis 104. The discharge port 192 may be spaced on an opposite side of the axis 104 from the intake port 190. The discharge port 192 may also extend between the first face 186 and the second face 188 of the ported member 184. The ported member 184 may be disposed within the housing 102 with the discharge port 192 aligned with and in fluid communication with the fluid outlet 136. Moreover, the discharge port 192 may be disposed substantially at the same radius as the pistons 112, 113 relative to the axis 104. Thus, the pistons 112, 113 may discharge fluid via the discharge port 192 when the pistons 112, 113 come into alignment with the discharge port 192. In other words, the discharge port 192 temporarily fluidly connects the pump chamber 170 of the first piston 112 and the fluid outlet 136 as the rotating group 106 rotates within the internal space 128. The discharge port 192 likewise temporarily fluidly connects the pump chamber 170 of the second piston 113 and the fluid outlet 136 and the other pistons as they rotate about the axis 104 with rotation of the rotating group 106.

Moreover, the ported member 184 may include a first balance aperture 194. The first balance aperture 194 may be a passage that extends from the first face 186 to the second face 188. As shown in FIGS. 1 and 2, the first balance aperture 194 may include a feed portion 196 and a cavity portion 198. The feed portion 196 may extend from the first face 186 and may have a smaller width (e.g., a smaller diameter) than the cavity portion 198. The cavity portion 198 may be open at the second face 188. As shown in FIG. 3, the first balance aperture 194 may be circumferentially spaced between the intake port 190 and the discharge port 192 on a first side of the axis 104. The first balance aperture 194 may be configured to pass fluid in a thickness direction through the ported member 184, between the first face 186 and the second face 188.

Still further, the ported member 184 may include a second balance aperture 200. The second balance aperture 200 may be a passage that extends from the first face 186 to the second face 188. As shown in FIG. 1, the second balance aperture 200 may include a feed portion 202 and a cavity portion 204. The feed portion 202 may extend from the first face 186 and may have a smaller width (e.g., a smaller diameter) than the cavity portion 204. The cavity portion 204 may be open at the second face 188. As shown in FIG. 3, the second balance aperture 200 may be circumferentially spaced between the intake port 190 and the discharge port 192. The second balance aperture 200 may be spaced between the intake and discharge ports 190, 192 on the opposite side of the axis 104 (e.g., approximately one hundred eighty degrees (180°)) from the first balance aperture 194. The second balance aperture 200 may be configured to pass fluid in a thickness direction through the ported member 184, between the first face 186 and the second face 188.

The ported member 184 may be received within the internal space 128 between the rotating group 106 and the end 126 of the housing 102. In some embodiments, the ported member 184 may "float" within this space between the rotating group 106 and the end 126 of the housing 102.

The ported member 184 may have a neutral position within the space 128. The ported member 184 may be substantially orthogonal to the axis 104 when in the neutral position. Also, the intake port 190 may be aligned with the fluid inlet 134 and the discharge port 192 may be aligned with the fluid outlet 136 when in the neutral position. The ported member 184 is moveably disposed (i.e., "floats") within the space 128. During operation of the pump 101, forces may tend to push the ported member 184 away from the neutral position and toward an unbalanced position. More specifically, these forces may tend to tilt the ported member 184 slightly to a non-orthogonal angle relative to the axis 104.

However, the pump 101 may include a first biasing member 207 and a second biasing member 209, which create a counter-balancing force for biasing the ported member 184 toward the neutral position. The first and second biasing members 207, 209 may create a counter-moment for maintaining the ported member 184 substantially orthogonal to the axis 104. The first biasing member 207 may be a substantially cylindrical member that is received in the cavity portion 198 of the first balance aperture 194. The size and shape of the first biasing member 207 may correspond substantially to that of the cavity portion 198. Likewise, the second biasing member 209 may be a substantially cylindrical member that is received in the cavity portion 204 of the second balance aperture 200. The size and shape of the second biasing member 209 may correspond substantially to that of the cavity portion 204.

Figure 12:
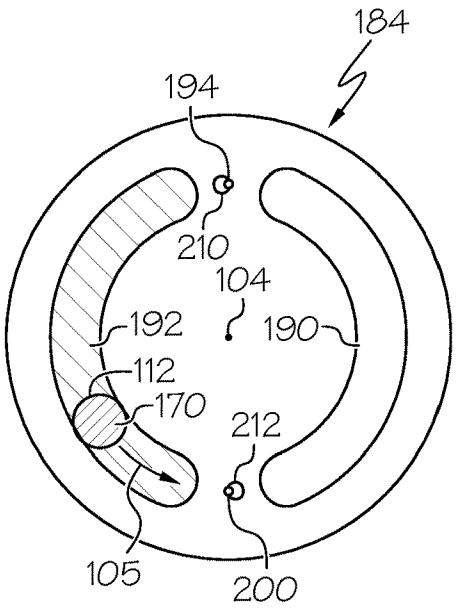
Figure 11:
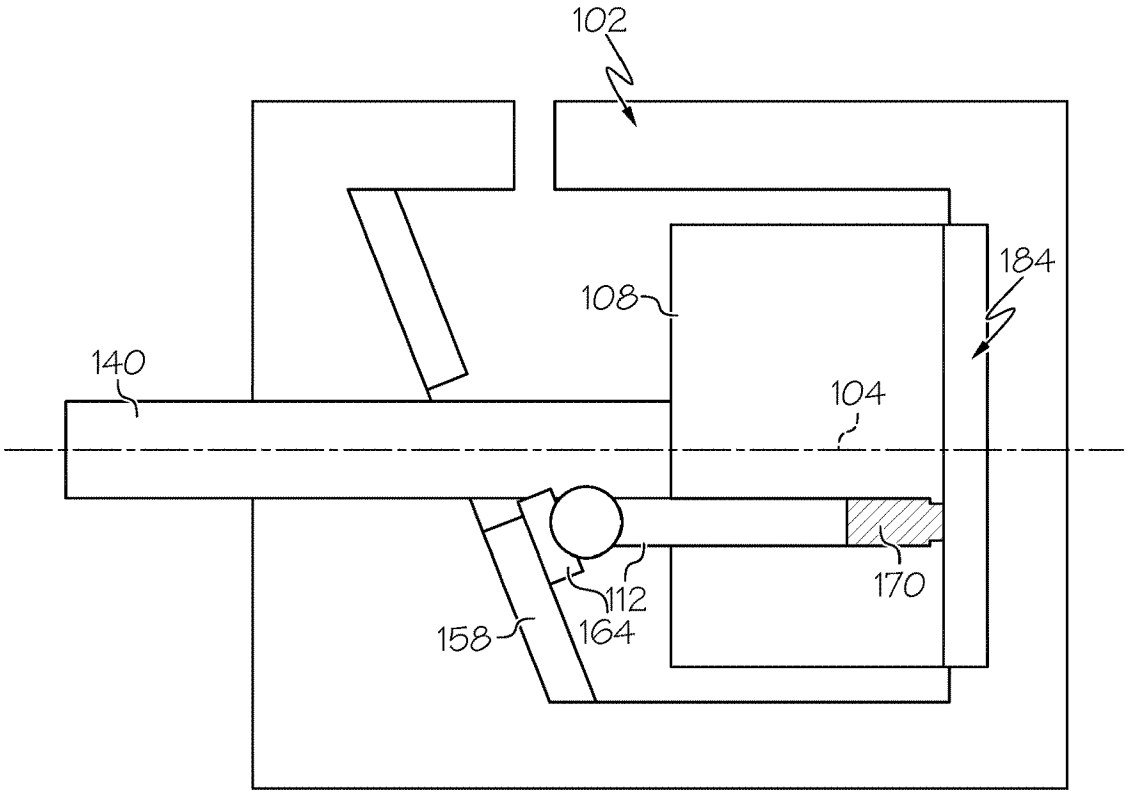
Figure 14:
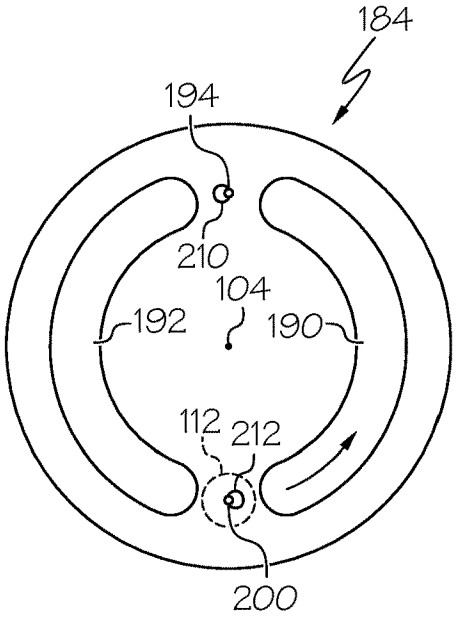
Figure 13:
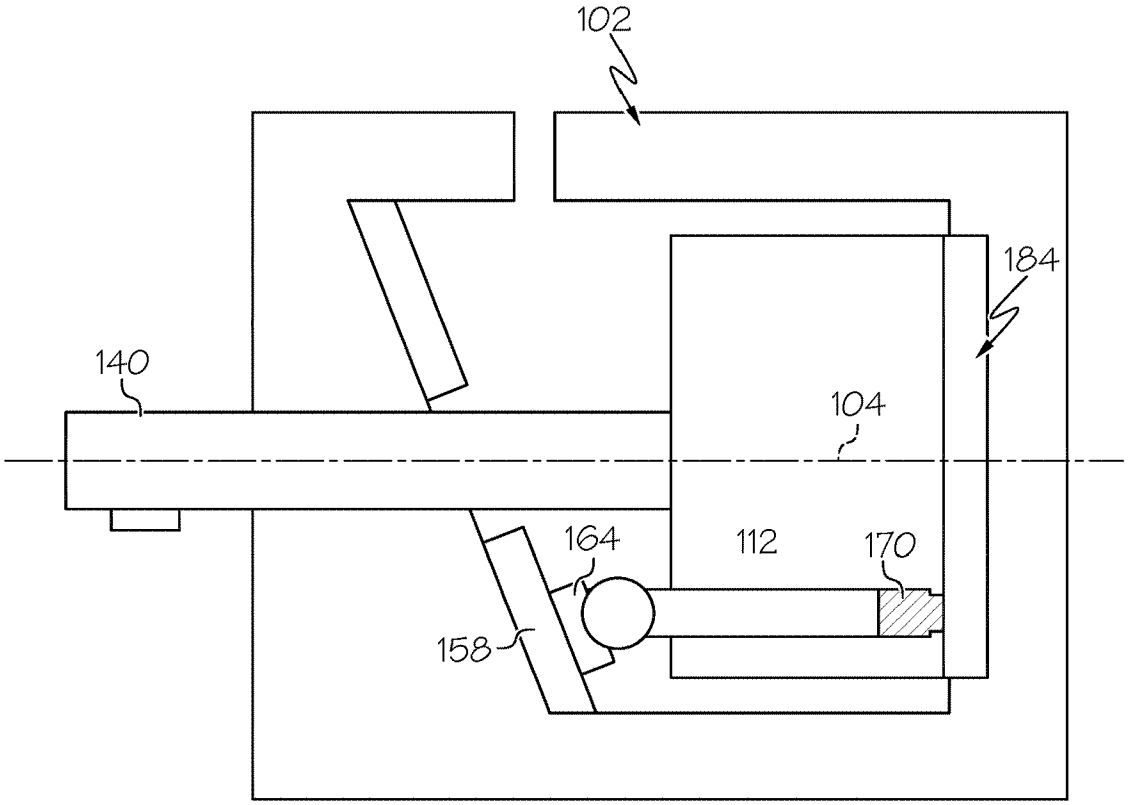

During operation, the pump chambers 170 of the pistons 112, 113 may intermittently connect fluidly to the first balance aperture 194 (e.g., in the position shown in FIGS. 7 and 8), and the pump chambers 170 of the pistons 112, 113 may intermittently connect fluidly to the second balance aperture 200 (e.g., in the position shown in FIGS. 11 and 12). In these positions, fluid may pass between the pump chambers 170 and the biasing members 207, 209 via the balance apertures 194, 200 such that the biasing members 207, 209 bias the ported member 184 toward the balanced, neutral position within the internal space 128.

The pump system 100 may further include a control system 206 (FIG. 1). The control system 206 may control various features of the pump 101. The control system 206 may be a computerized system, for example, with one or more processors, memory elements, input and output devices, etc. Also, the control system 206 may include and/or incorporate at least one actuator 208. The actuator(s) 208 may include one or more fluid actuators, pneumatic actuators, electric actuators, etc. The actuator(s) 208 may include a shaft actuator for rotating the shaft 140. Additionally, the actuator(s) 208 may include a cam actuator for actuating the cam plate 158, for example, for selectively changing the angle 141 (e.g., in a variable displacement pump configuration). Stated differently, although the pump 101 illustrated in FIG. 1 is a fixed displacement pump, the pump 101 may be configured as a variable displacement pump wherein the actuator 208 actuates to change the angle 141. Changing the angle 141 changes the stroke length of the pistons 112, 113 during a single rotation of the rotating group 106 about the axis 104. The control system 206 may receive inputs, such as input from a sensor, that detects an operating condition and/or that distinguishes between different operating conditions. As mentioned above, the pump system 100 may be incorporated as a fuel pump for an engine in some embodiments. In this case, the control system 206 may receive sensor input indicating a throttle position, a user request, and/or other input. The control system 206 may process the input and, in turn, generate control signals for the actuator(s) 208 according to the processed input. For example, the actuator 208 may change the speed of the shaft 140 according to control signals sent from the control system 206. In the case of a variable displacement pump 101, the control system 206 may command the actuator 208 to change the angle 141.

Rotation of the shaft and the position of the piston 112 relative to the ported member 184 is shown schematically in FIGS. 7-14. The first piston 112 is illustrated, but it will be appreciated that the second piston 113 and/or the others of the pistons may operate similarly. The direction of rotation of the piston 112 about the axis 104 relative to the ported member 184 is indicated with arrow 105.

Figure 8:
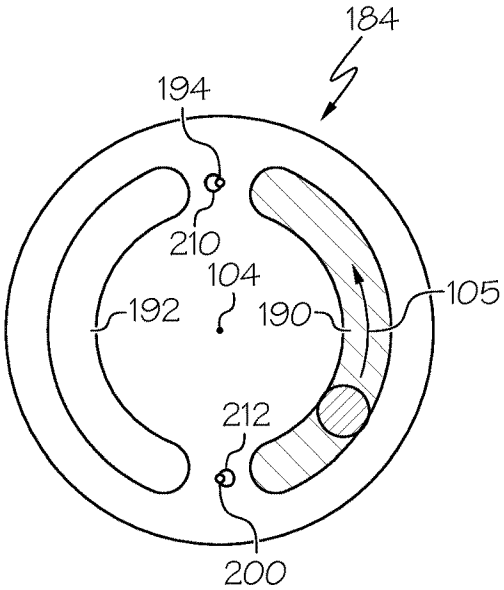
FIGS. 7-14 are schematic views of the axial piston pump illustrating operation of the pump.
Figure 7:
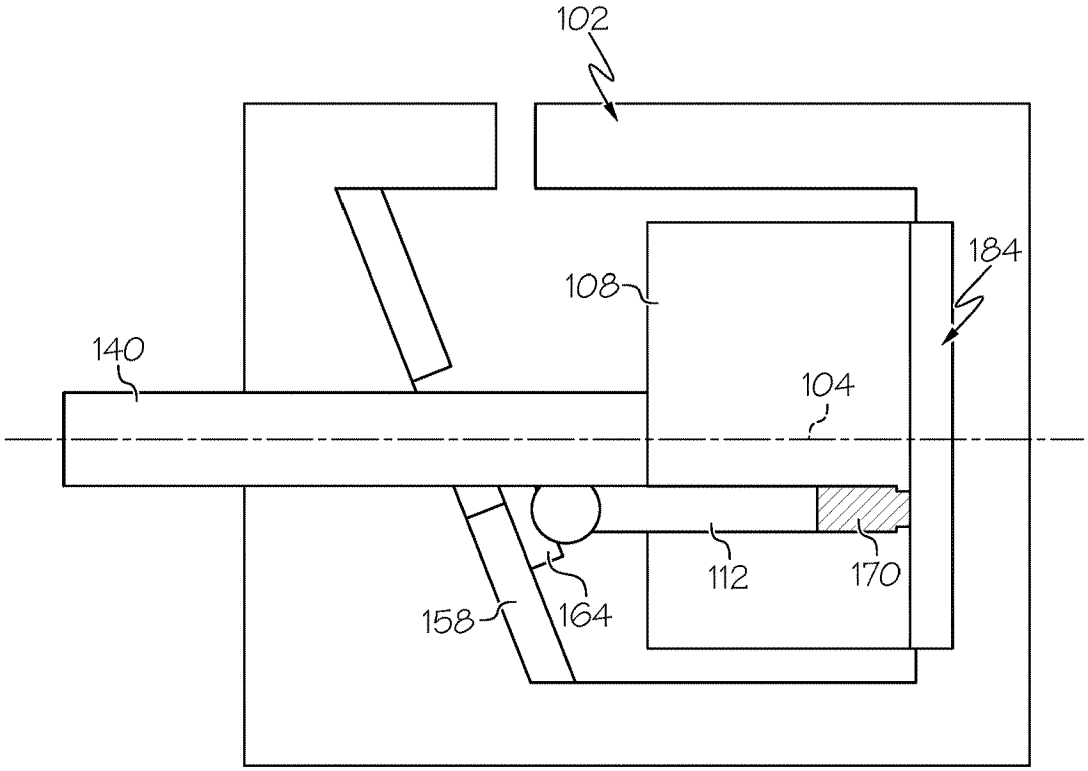

Beginning, for example, at the circumferential position of the piston 112 represented in FIGS. 7 and 8, the pump chamber 170 of the first piston 112 may be aligned with the intake port 190 of the ported member 184 (i.e., moves circumferentially between the arcuate ends of the intake port 190). The piston 112 may remain aligned with the intake port 190 and may continue to withdraw from the rotor member 108 as the rotating group 106 rotates, thereby drawing the fluid from the fluid inlet 134, through the intake port 190, and into the pump chamber 170. The piston 112 continues to advance in the circumferential direction to a first intermediate position represented in FIGS. 9 and 10. Then, as shown in FIGS. 11 and 12 the piston 112 rotates into alignment with the discharge port 192 (i.e., moves circumferentially between the arcuate ends of the discharge port 192) while advancing into the respective bore 144 to thereby discharge the fluid from the pump chamber 170 to the fluid outlet 136. The piston 112 continues to a second intermediate position represented in FIGS. 13 and 14. The rotational cycle continues with the piston 112 aligning with the intake port 190 (FIGS. 7 and 8) and so on during rotation of the rotating group 106.

Figure 10:
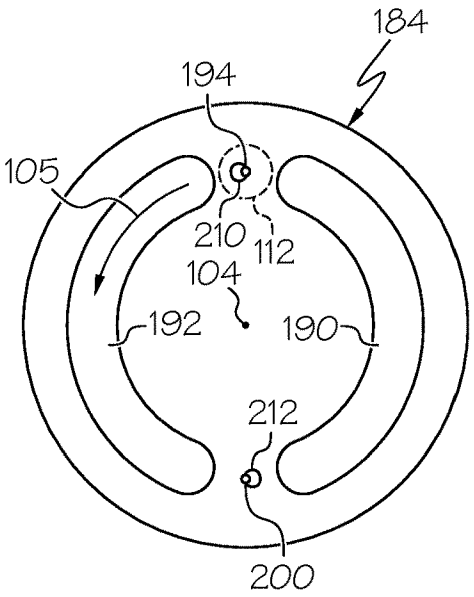
Figure 9:
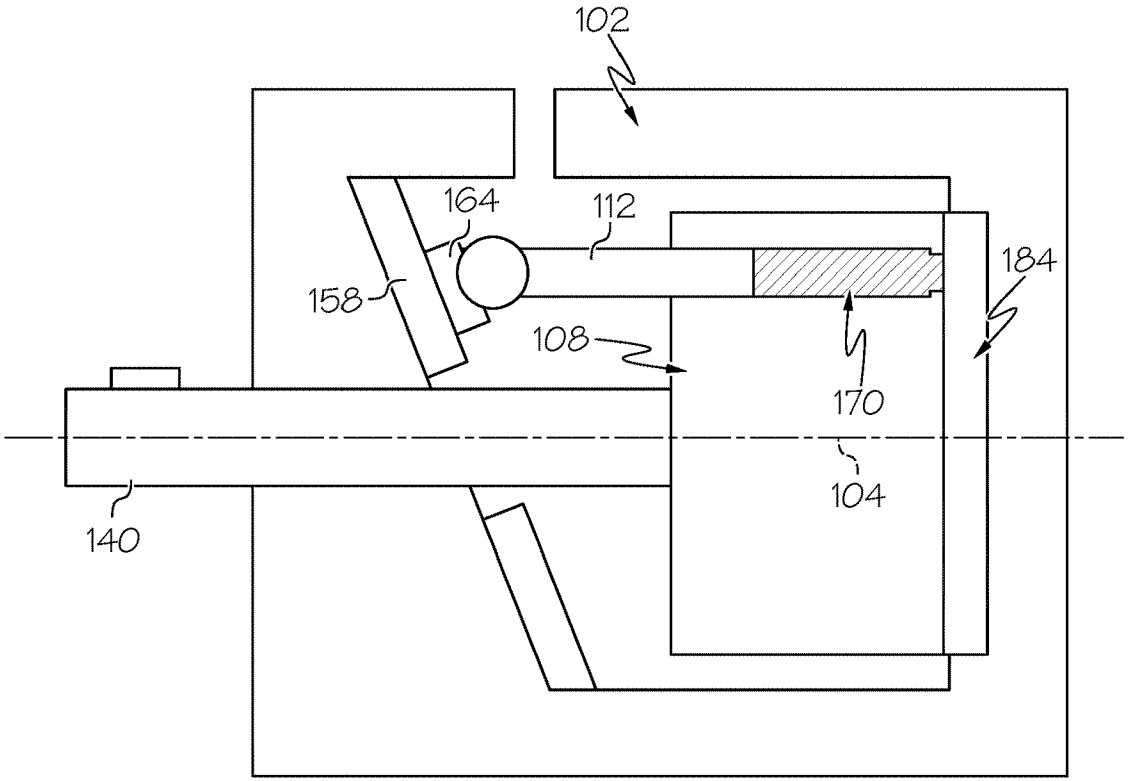

In the first intermediate position of FIGS. 9 and 10, the pump chamber 170 is in fluid communication with the first balance aperture 194. As such, fluid may flow between the pump chamber 170 of the piston 112/bore 144 and the first biasing member 207 via the aperture 194. Fluid pressure causes the first biasing member 207 to bias the ported member 184 toward the balanced, neutral position within the internal space 128 (e.g., orthogonal to the axis 104) as the rotating group 106 rotates about the axis 104. Likewise, in the second intermediate position of FIGS. 13 and 14, the pump chamber 170 is in fluid communication with the second balance aperture 200. As such, fluid may flow between the pump chamber 170 and the second biasing member 209 via the aperture 200. Fluid pressure causes the second biasing member 209 to bias the ported member 184 toward the balanced, neutral position within the internal space 128 (e.g., orthogonal to the axis 104) as the rotating group 106 rotates about the axis 104. The first and second biasing members 207, 209 may operate together in concert to bias the ported member 184 toward the balanced, neutral position.

As shown in FIGS. 2-6, the ported member 184 may include one or more relief features 210, 212. Generally, the relief feature(s) 210, 212 may be, may include, and/or may comprise a recess in the first face 186, which is proximate the first balance aperture 194 or the second balance aperture 200 to affect flow into and/or out of the apertures 194, 200. As shown in the illustrations, the ported member 184 may a first relief feature 210 disposed proximate the first balance aperture 194 and a second relief feature 212 disposed proximate the second balance aperture 200.

Figure 4:
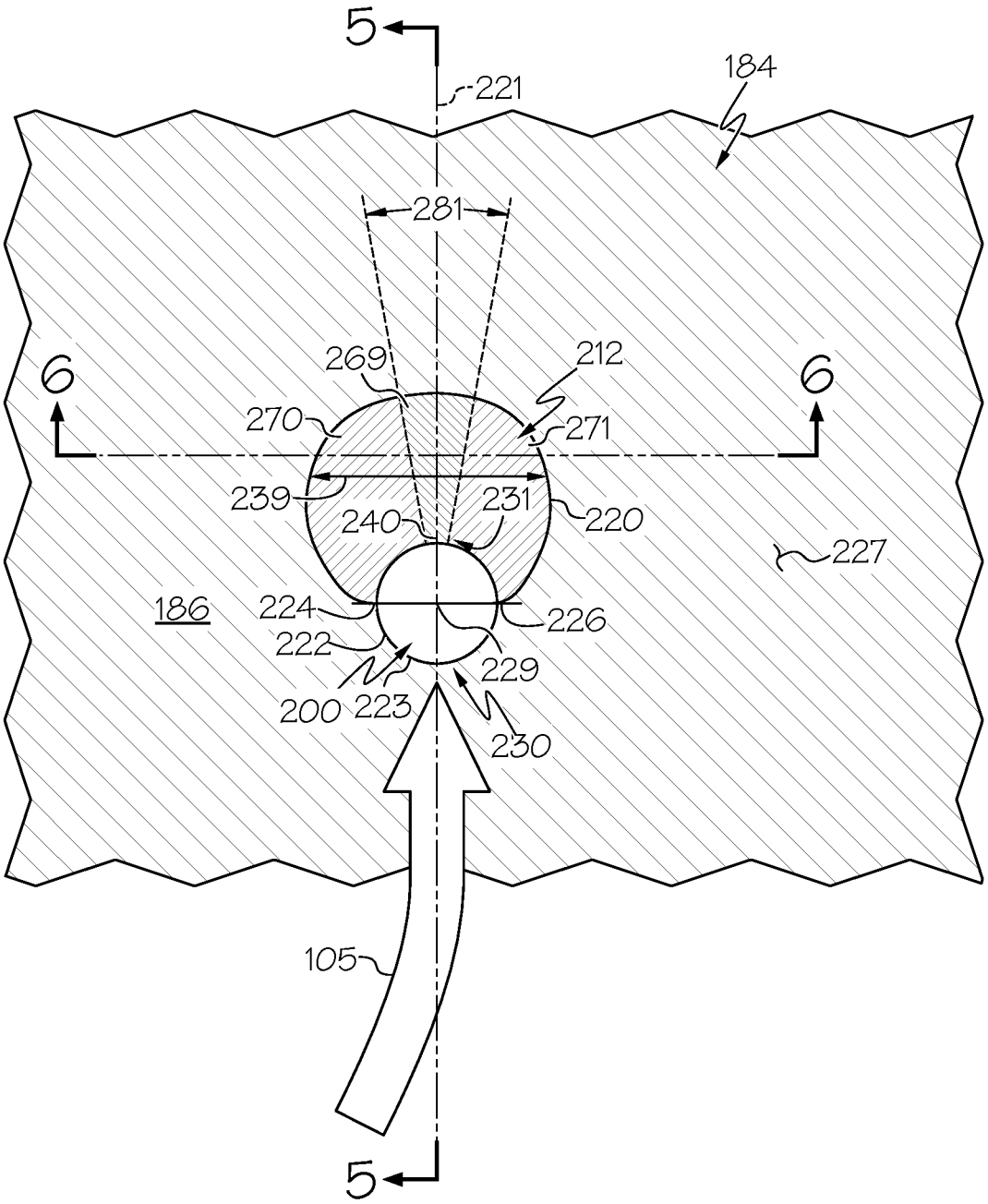
FIG. 4 is a plan view of a balance aperture relief feature of the ported member of FIG. 3.
Figure 5:
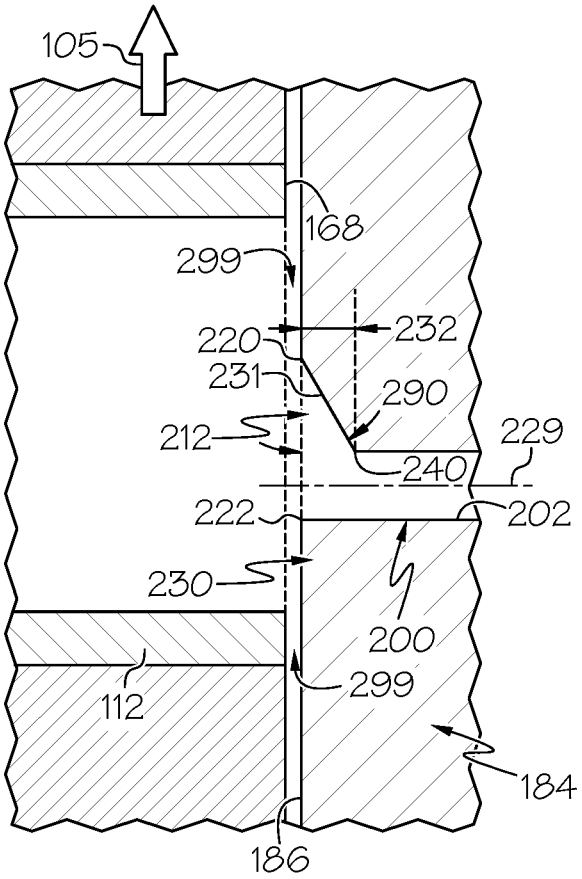
FIG. 5 is a cross-section view of the piston and the ported member taken along the line 5-5 of FIG. 4.
Figure 6:
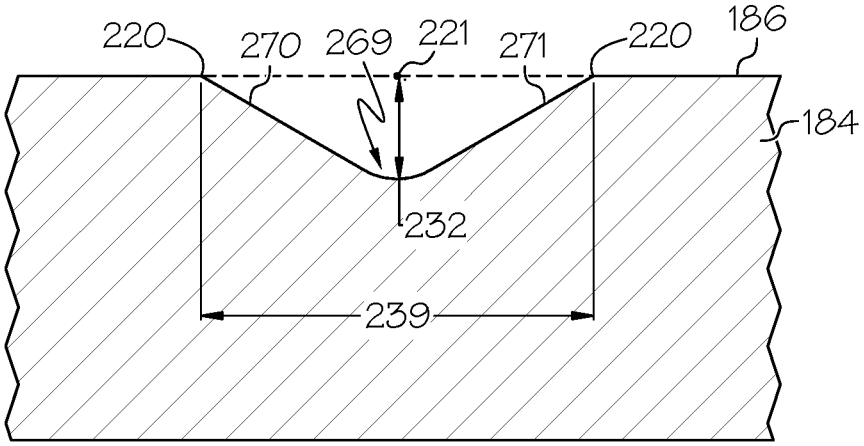
FIG. 6 is a cross-section view of the ported member taken along the line 6-6 of FIG. 4.

Referring to FIGS. 4-6, the second relief feature 212 will be discussed as an example. It will be appreciated that the first relief feature 210 may be similar to the second relief feature 212. In other embodiments, the first and second relief feature 210, 212 may have different sizes, shapes, or other differences.

The relief feature 212 may be a groove, notch, pocket, indent, rut, or other aperture recessed into the first face 186. The relief feature 212 may be defined by an outer boundary 220, which is flush with a surrounding, adjacent area 227 of the first face 186. The outer boundary 220 may be rounded and somewhat arcuate. In some embodiments, the outer boundary 220 may be teardrop and/or lobe-shaped. The relief feature 212 may be recessed gradually into the first face 186 within interior portions that are bound by the outer boundary 220 as will be discussed.

The outer boundary 220 may define a relief axis 221 that extends along the first face 186. The relief axis 221 may be substantially straight and may define a line of symmetry for the outer boundary 220 in some embodiments. The relief feature 212 may have a width 239 measured between opposite sides of the outer boundary 220 and measured perpendicular to the relief axis 221. The width 239 of the relief feature 212 may vary along the relief axis 221. The relief feature 212 may also have a depth 232 that is measured in the thickness direction of the ported member 184 (perpendicular to the first face 186 and parallel to the axis 104). The depth 232 may gradually increase from the outer boundary 220 toward the interior region of the relief feature 212.

The relief feature 212 may be disposed proximate the first balance aperture 200. Specifically, the outer boundary 220 may intersect a rim 222 of the second balance aperture 200. Accordingly, as shown in FIG. 4, the outer boundary 220 may be shaped as a rounded lobe of the rim 222. Accordingly, the relief feature 212 may define a gradual, tapered, sloped, and/or contoured transition between the first face 186 and the balance aperture 200, and the relief feature 212 may define a fluid flow path into or out of the balance aperture 200.

As shown, the feed portion 202 (FIGS. 1 and 5) of the second balance aperture 200 may be a circular hole that extends along an axis 229 and that terminates at the rim 222. The rim 222 may be substantially disposed in a plane that is perpendicular to the axis 229 and substantially flush with the adjacent area 227 of the first face 186. (Those having ordinary skill in the art will understand that the term "substantially" is used in this context to account for the rim 222 to be chamfered or otherwise treated to remove burrs or another sharpened edge during the manufacturing process.) As shown in FIG. 4, the rim 222 may include a rounded portion 223 (e.g., a semi-circular portion) with a first circumferential end 224 and a second circumferential end 226. The rounded portion 223 may be centered about the balance aperture axis 229. Also, the rounded portion 223 may define a leading side 230 of the balance aperture 200. (It will be appreciated that the piston 112, moving angularly around the axis 104 as indicated by arrow 105 in FIGS. 4 and 5, moves over the leading side 230 of the aperture 200 before moving over a trailing side 231 as indicated in FIGS. 4 and 5.)

The relief feature 212 may intersect and interrupt the circular shape of the rim 222. As such, the first end 224 and the second end 226 are separated by the relief feature 212 in the circumferential direction about the axis 229. Stated differently, the outer boundary 220 may intersect the rim 222 at the first end 224, and the outer boundary 220 may intersect the rim 222 at the second end 226. As shown in FIG. 4, these intersections may be spaced approximately 180 degrees apart and on opposite sides of the axis 229 in some embodiments. Furthermore, the relief axis 221 may intersect the axis 229 of the aperture 200 and may extend therefrom. Moving around the axis 229, the rounded portion 223 of the rim 222 may be substantially flush with the adjacent area 227, and between the first and second ends 224, 226, a junction portion 240 of the relief feature 212 may be gradually recessed. Accordingly, the rim 222 may be cleft and recessed at the junction portion 240 of the relief feature 212. Thus, the rim 222 may be referred to as a "cleft rim," and the rim 22 may be characterized as "clefted" or "cleaved" at the junction portion 240 of the relief feature 212.

The relief feature 212 may be disposed on the trailing side 231 of the balance aperture 200. In some embodiments, the relief axis 221 may intersect the balance aperture axis 229 and may extend away from the balance aperture 200 (normal to the axis 229) across the first face 186. The relief axis 221 may be spaced equally from the first end 224 and the second end 226 of the rim 222. Furthermore, the relief feature 212 may be substantially symmetrical with respect to the relief axis 221.

As shown in FIG. 4, the width 239 gradually expands as the relief feature 212 spans along the relief axis 221, across the first face 186, and away from the junction portion 240. The width 239 gradually reduces to zero as the relief feature 212 spans further along the relief axis 221 away from the balance aperture 200. Conversely, when moving from the outer boundary 220 along the axis 221 toward the junction portion 240, the width 239 gradually increases, reaches a maximum, and then gradually reduces to the diameter of the feed portion 202 of the aperture 200. Accordingly, the outer boundary 220 of the relief feature 212 may be shaped as a rounded lobe on the trailing side 231 of the aperture 200.

The depth 232 may vary across the relief feature 212 (i.e., in a first direction perpendicular to the relief axis 221) as shown in FIG. 6. Also, the depth 232 may vary along the relief feature 212 (i.e., in a second direction parallel to the relief axis 221) as shown in FIG. 5. Specifically, as shown in FIG. 6, moving across the relief feature 212 perpendicular to the relief axis 221 from one part of the outer boundary 220 to an opposite part of the outer boundary 220, the depth 232 may gradually increase, reaching a maximum at a central zone 269, and then gradually reduce. Accordingly, the relief feature 212 may have a V-shaped cross-sectional profile taken perpendicular to the relief axis 221. Furthermore, as shown in FIG. 5, moving along the axis 221 from the outer boundary 220 to the balance aperture 200, the depth 232 may gradually increase and reach a maximum at the junction portion 240.

Moreover, as indicated in FIG. 4, the relief feature 212 may define different zones that have different surface taper angles, surface contours, etc. For example, the central zone 269 may extend along the axis 221 between the aperture 200 and the outer boundary 220 and may be disposed at a gradual taper angle 290 as shown in FIG. 5. As shown in FIG. 4, the relief feature 212 may also include a first side zone 270 and a second side zone 271, which are disposed on opposite sides of the central zone 269 and on opposite sides of the relief axis 221. The central zone 269 may define the deepest portions of the relief feature 212 as compared to the depth 232 measured at the first and second side zones 270, 271. In other words, in a cross section taken perpendicular to the relief axis 221, the first and second side zones 270, 271 may gradually increase in depth until the central zone 269 is reached. The depth 232 of the relief feature 212 may be greatest in the central zone 269, at the junction portion 240 of the relief feature 212 (FIG. 5). The central zone 269 may also be wedge-shaped as shown in FIG. 4, and may extend out to each side of the axis 221 at an angle 281. Thus, the central zone 269 may gradually increase in width in a direction moving away from the aperture 200 and may terminate at the outer boundary 220.

As shown in FIGS. 2 and 3, and as mentioned above, the relief feature 210 may be similar to the relief feature 212. However, the relief feature 210 may be a lobe-shaped recess disposed on the trailing side 231 of the first balance aperture 194.

During operation of the pump 101 (FIGS. 5, 9, 10, 13, and 14), the pump chambers 170 of the rotating group 106 communicate with the balance apertures 194, 200. The relief features 210, 212 define gradual and tapered surfaces for flow into and/or out of the balance apertures 194, 200 to provide laminar and/or near-laminar flow. Accordingly, flow cavitation is unlikely to occur and/or bubbles that form may move away from the interface 299 (FIG. 5) between the ported member 184 and the rotating group 106. Specifically, the relief features 210, 212 provide tapered transition surfaces between the first face 186 and the opposing face of the rotating group 106, allowing bubbles to move into the apertures 194, 200 and away from the interface 299. Accordingly, damage due to cavitation is unlikely to occur. Thus, the relief features 210, 212 increase the durability and robustness of the pump 101.

The relief features 210, 212 may be formed, in some embodiments, by removing material away from the ported member 184. For example, the ported member 184 may be formed by injection molding, by casting, or by other method. Subsequently, the relief features 210, 212 may be formed using a milling operation (using a milling tool). The milling tool may cut into and remove material from the ported member 184, thereby defining the depth 232 and width 239 of the relief features 210, 212. Once the ported member 184 is formed, it may be provided in the pump 101 between the housing 102 and the rotating group 106 as discussed above.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the air quality control system described herein is merely one exemplary embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment of the present disclosure. It is understood that various changes may be made in the function and arrangement of elements described in an exemplary embodiment without departing from the scope of the present disclosure as set forth in the appended claims.

What is claimed is:

1. A piston pump configured to displace a fluid comprising:

a housing that defines an internal space, the housing having a fluid inlet into the internal space, the housing having a fluid outlet out of the internal space;

a rotating group that is supported for rotation within the internal space of the housing, the rotating group including a rotor member with a bore therein and a piston supported for movement within the bore as the rotating group rotates to change a volume of a pump chamber that is cooperatively defined by the piston and the rotor member;

a biasing member; and a ported member that is moveably disposed within the internal space of the housing between the rotating group and the housing, the ported member including a first face facing the rotating group and a second face facing the fluid inlet and the fluid outlet, the ported member including an intake port that fluidly connects the fluid inlet and the pump chamber as the rotating group rotates within the internal space, the ported member including a discharge port that fluidly connects the pump chamber and the fluid outlet as the rotating group rotates within the internal space, the ported member including a balance aperture configured to pass fluid between the biasing member and the pump chamber as the rotating group rotates within the internal space such that the biasing member biases the ported member toward a balanced position within the internal space;

the balance aperture having a rim at the first face, the rim having a leading side and a trailing side, the rotating group supported for rotation in a direction in which the piston moves across the leading side before the trailing side, the rim being clefted at a relief feature of the first face, the relief feature recessed into the first face and disposed on the trailing side of the rim;

the rim including a rounded portion with a first end and a second end that are separated by a junction portion of the relief feature; and the relief feature having a width that gradually expands as the relief feature spans across the first face and away from junction portion.

2. The piston pump of claim 1, wherein the relief feature has an outer boundary that intersects the rim at the first end and the second end; and wherein the relief feature has a depth that gradually increases as the relief feature spans away from the outer boundary toward an interior area of the relief feature.

3. The piston pump of claim 2, wherein the depth gradually increases in a first direction and a second direction as the relief feature spans away from the outer boundary toward the interior area of the relief feature; and wherein the first direction and the second direction are perpendicular and directed across the first face.

4. The piston pump of claim 2, wherein the depth of the relief feature is greatest at the junction portion of the relief feature.

5. The piston pump of claim 1, wherein the rotating group is supported for rotation about an axis;

wherein the biasing member is a first biasing member, wherein the balance aperture is a first balance aperture, wherein the rim is a first rim, and the relief feature is a first relief feature;

further comprising a second biasing member;

wherein the ported member further includes a second balance aperture configured to pass fluid between the second biasing member and the pump chamber as the rotating group rotates within the internal space such that the second biasing member biases the ported member toward the balanced position within the internal space as the rotating group rotates therein;

wherein the second balance aperture has a second rim at the first face, the second rim being clefted at a second relief feature of the first face, the second relief feature recessed into the first face;

wherein the first balance aperture is disposed circumferentially between the intake port and the discharge port on a first side of the axis; and wherein the second balance aperture is disposed circumferentially between the intake port and the discharge port on a second side of the axis.

6. The piston pump of claim 1, wherein the fluid is an engine fuel.

7. The piston pump of claim 1, wherein the rotor member and the piston are configured as an axial piston pump.

8. A piston pump configured to displace a fluid comprising:

a housing that defines an internal space, the housing having a fluid inlet into the internal space, the housing having a fluid outlet out of the internal space;

a rotating group that is supported for rotation within the internal space of the housing, the rotating group including a rotor member with a bore therein and a piston supported for movement within the bore as the rotating group rotates to change a volume of a pump chamber that is cooperatively defined by the piston and the rotor member;

a biasing member; and a ported member that is moveably disposed within the internal space of the housing between the rotating group and the housing, the ported member including a first face facing the rotating group and a second face facing the fluid inlet and the fluid outlet, the ported member including an intake port that fluidly connects the fluid inlet and the pump chamber as the rotating group rotates within the internal space, the ported member including a discharge port that fluidly connects the pump chamber and the fluid outlet as the rotating group rotates within the internal space, the ported member including a balance aperture configured to pass fluid between the biasing member and the pump chamber as the rotating group rotates within the internal space such that the biasing member biases the ported member toward a balanced position within the internal space;

the balance aperture having a rim at the first face, the rim being clefted at a relief feature of the first face, the relief feature recessed into the first face;

wherein the rim includes a rounded portion with a first end and a second end that are separated by a junction portion of the relief feature;

wherein the relief portion has an outer boundary that intersects the rim at the first end and the second end; and wherein the outer boundary is shaped as a rounded lobe of the rim, with the outer boundary expanding in width as the relief feature spans in a direction away from the rim; and wherein the relief feature has a width that gradually increases as the relief feature spans in a direction away from the outer boundary toward the junction portion.

9. The piston pump of claim 8, where in the rounded portion is semi-circular.

10. The piston pump of claim 8, wherein the rounded portion is centered about an axis; and wherein the relief feature is symmetrical with respect to a line of symmetry that extends along the first face and through the axis.

11. The piston pump of claim 8, wherein the rounded portion is centered about a first axis;

wherein the relief feature includes a central zone that extends along a second axis that extends transverse to the first axis;

wherein the relief feature includes a first side zone and a second side zone that are disposed on opposite sides of the central zone; and wherein a depth of the relief feature is greater at the central zone than at the first and second side zones.

12. The piston pump of claim 8, wherein the rim of the balance aperture has a leading side and a trailing side;

wherein the rotating group is supported for rotation in a direction in which the piston moves across the leading side before the trailing side; and wherein the relief feature is disposed on the trailing side of the rim.

13. The piston pump of claim 8, wherein the rotating group is supported for rotation about an axis;

wherein the biasing member is a first biasing member, wherein the balance aperture is a first balance aperture, wherein the rim is a first rim, and the relief feature is a first relief feature;

further comprising a second biasing member;

wherein the ported member further includes a second balance aperture configured to pass fluid between the second biasing member and the pump chamber as the rotating group rotates within the internal space such that the second biasing member biases the ported member toward the balanced position within the internal space as the rotating group rotates therein;

wherein the second balance aperture has a second rim at the first face, the second rim being clefted at a second relief feature of the first face, the second relief feature recessed into the first face;

wherein the first balance aperture is disposed circumferentially between the intake port and the discharge port on a first side of the axis; and wherein the second balance aperture is disposed circumferentially between the intake port and the discharge port on a second side of the axis.

14. The piston pump of claim 8, wherein the fluid is an engine fuel.

15. The piston pump of claim 8, wherein the rotor member and the piston are configured as an axial piston pump.

16. A method of operating an axial piston pump comprising:

rotating a rotating group of the axial piston pump within an internal space of a housing of the axial piston pump, the housing having a fluid inlet into the internal space and a fluid outlet out of the internal space;

moving a piston of the rotating group reciprocally in an axial direction within a bore of the rotating group to move a fluid through a pump chamber that is cooperatively defined by the piston and the rotor member;

moving the fluid through a ported member that is moveably disposed within the internal space of the housing between the rotating group and the housing, the ported member including a first face facing the rotating group and a second face facing the fluid inlet and the fluid outlet, wherein moving the fluid through the ported member includes:

moving the fluid from the fluid inlet to the pump chamber via an intake port of the ported member as the rotating group rotates within the internal space;

moving the fluid from the pump chamber to the fluid outlet via a discharge port of the ported member as the rotating group rotates within the internal space; and passing the fluid between the pump chamber and a biasing member via a balance aperture of the ported member as the rotating group rotates within the internal space such that the biasing member biases the ported member toward a balanced position within the internal space, including passing the fluid through a clefted rim of the balance aperture defined at the first face, the rim being clefted at a relief feature of the first face, the relief feature recessed into the first face, the rim including a rounded portion with a first end and a second end that are separated by a junction portion of the relief feature, the relief feature having an outer boundary that intersects the rim at the first end and the second end, the outer boundary being shaped as a rounded lobe of the rim with the outer boundary expanding in width as the relief feature spans in a direction away from the rim, and the relief feature having a width that gradually increases as the relief feature spans in a direction away from the outer boundary toward the junction portion.

17. The method of claim 16, further comprising:

receiving, by a control system, sensor input from a sensor, the sensor input based on a condition detected by the sensor; and controlling, by the control system, an actuator based on the sensor input to change the reciprocating movement of the piston.

18. The method of claim 16, wherein rotating the rotating group includes moving the piston across a leading side of the balance aperture before the piston moves across a trailing side of the balance aperture; and wherein the relief feature is disposed on the trailing side of the balance aperture.

19. The method of claim 16, wherein the fluid is an engine fuel.

20. The method of claim 16, wherein the relief feature has a depth that gradually increases as the relief feature spans away from the outer boundary toward an interior area of the relief feature.

* * * * *